US010201981B2

(12) United States Patent
Gracia Verdugo et al.

(10) Patent No.: US 10,201,981 B2
(45) Date of Patent: Feb. 12, 2019

(54) DETERMINING AN AMOUNT OF TRANSLUCENT PRINTING FLUID

(71) Applicant: HEWLETT-PACKARD DEVELOPMENT COMPANY, L.P., Houston, TX (US)

(72) Inventors: Antonio Gracia Verdugo, Barcelona (ES); David Toussaint, Sant Cugat del Valles (ES); Oriol Borrell Avila, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/113,490

(22) PCT Filed: Jan. 24, 2014

(86) PCT No.: PCT/EP2014/051391
§ 371 (c)(1),
(2) Date: Jul. 22, 2016

(87) PCT Pub. No.: WO2015/110169
PCT Pub. Date: Jul. 30, 2015

(65) Prior Publication Data

US 2017/0008299 A1 Jan. 12, 2017

(51) Int. Cl.
*B41J 2/165* (2006.01)
*B41J 2/21* (2006.01)
*B41J 29/393* (2006.01)

(52) U.S. Cl.
CPC ..... *B41J 2/2103* (2013.01); *B41J 2/2114* (2013.01); *B41J 29/393* (2013.01)

(58) Field of Classification Search
None
See application file for complete search history.

(56) References Cited

U.S. PATENT DOCUMENTS 6,409,301 B1 * 6/2002 Takata ..... B41J 29/393 347/19
7,616,910 B2 11/2009 Bessho
(Continued)

FOREIGN PATENT DOCUMENTS

JP 2003039644 2/2003
JP 2007176025 7/2007
(Continued)

OTHER PUBLICATIONS

Shimodaira, et al. Laser Beam Printer Adjustment by Use of Subjective Evaluation Pattern. Nov. 1993.
(Continued)

*Primary Examiner* — Alejandro Valencia
(74) *Attorney, Agent, or Firm* — HP Inc. Patent Department

(57) ABSTRACT

An example method for determining an amount of a translucent printing fluid in accordance with the present disclosure is provided. The example method comprises printing a plurality of test patterns with different proportions of colored and translucent printing fluids. The plurality of test patterns comprise a first area and a second area contiguous with the first area, wherein a color of the second area is different from a color of the first area. Migration characteristics of the plurality of test patterns are analyzed to determine an amount of translucent printing fluid to use for a successive printing operation.

22 Claims, 7 Drawing Sheets

(56) References Cited

U.S. PATENT DOCUMENTS

| | | | | |
|---|---|---|---|---|
| 8,086,124 | B2 | 12/2011 | Zaima | |
| 8,310,721 | B2 | 11/2012 | Saita et al. | |
| 2003/0151643 | A1* | 8/2003 | Doi | B41J 2/2114 347/43 |
| 2005/0212835 | A1 | 9/2005 | Konno | |
| 2006/0071991 | A1* | 4/2006 | Yamanobe | B41J 2/2114 347/95 |
| 2006/0203019 | A1 | 9/2006 | Yamanobe | |
| 2007/0188541 | A1 | 8/2007 | Hoshino | |
| 2010/0165021 | A1* | 7/2010 | Mitsuzawa | B41J 29/38 347/9 |
| 2011/0249058 | A1* | 10/2011 | Shibata | C09D 11/322 347/21 |
| 2012/0081442 | A1* | 4/2012 | Ikeda | H04N 1/6038 347/15 |

FOREIGN PATENT DOCUMENTS

| | | |
|---|---|---|
| JP | 2007183593 | 7/2007 |
| JP | 2011121234 | 6/2011 |
| JP | 2011206930 | 10/2011 |
| JP | 2012035446 | 2/2012 |
| JP | 2013028025 | 2/2013 |

OTHER PUBLICATIONS

European Patent Office, International Search Report and Written Opinion for PCT/EP2014/051391 dated Oct. 13, 2014 (12 pages).

* cited by examiner

DETERMINING AN AMOUNT OF TRANSLUCENT PRINTING FLUID

BACKGROUND

Some printing systems include a colored printing fluid and a translucent printing fluid. For example, inkjet printing systems may comprise inkjet printheads having nozzles from which drops of a colored printing fluid, such as ink, are ejected onto a print medium. In laser printing systems, a laser beam may be passed over a charged drum to define an image. Colored printing fluid in the form of (liquid) toner may then be collected on the drum to subsequently transfer the image to a print medium.

The role of a translucent printing fluid in these printing systems may be to improve the bond between the colored printing fluid and the print medium. Herein a translucent printing fluid may be understood as a separate printing fluid in addition to one or more colored printing fluids.

BRIEF DESCRIPTION

Figure 1A:
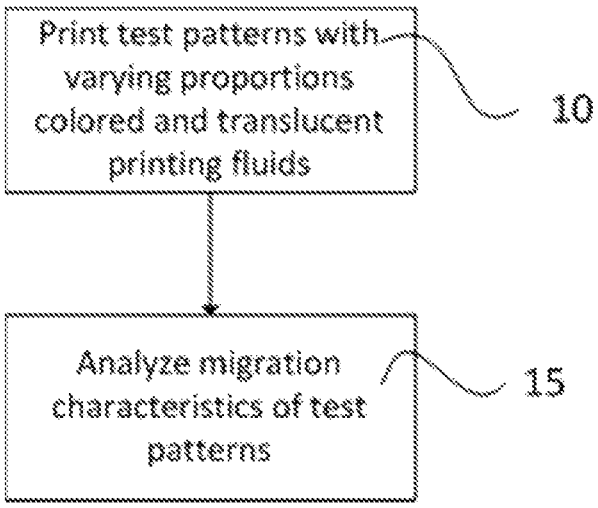
Figure 1B:
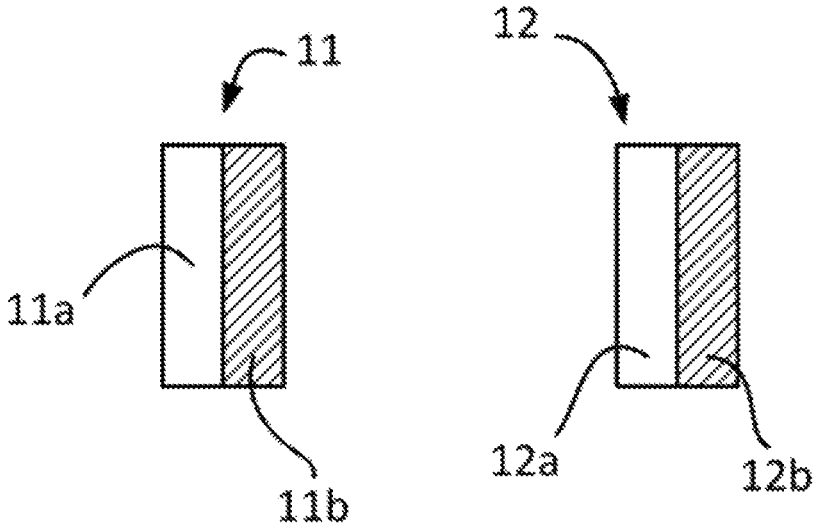
Figure 1C:
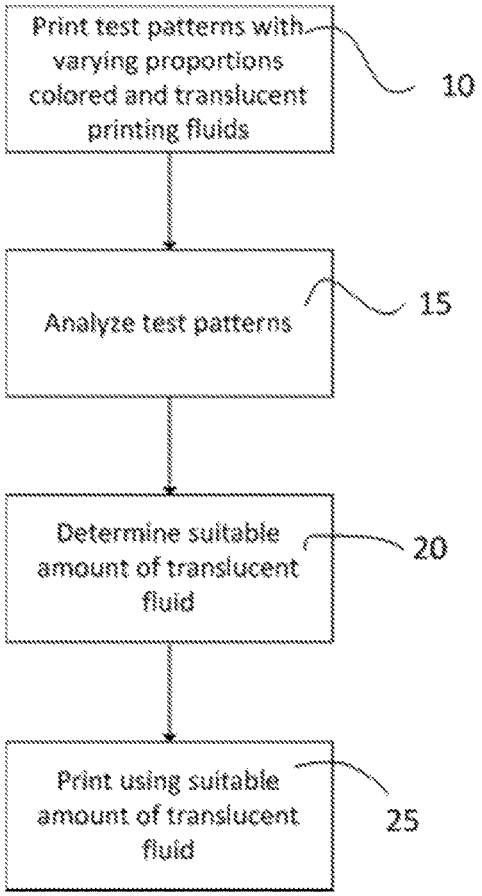
Figure 2:
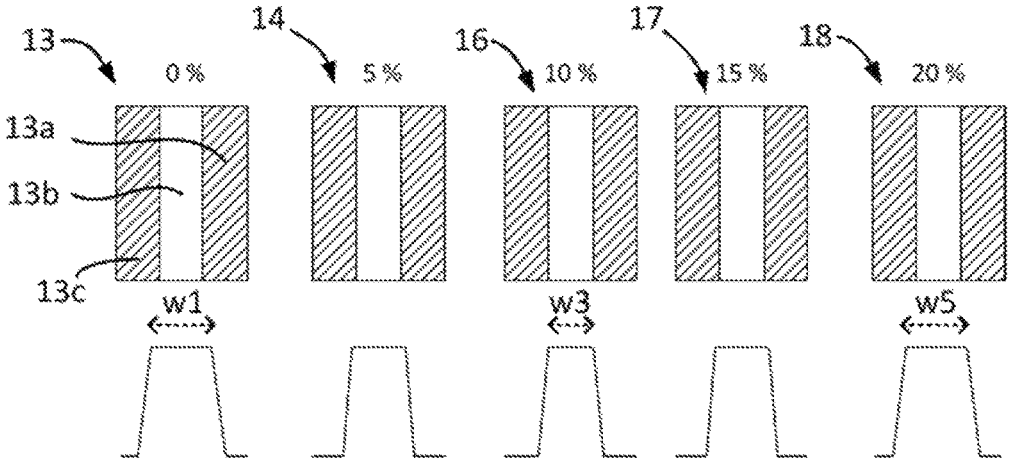
Figure 3:
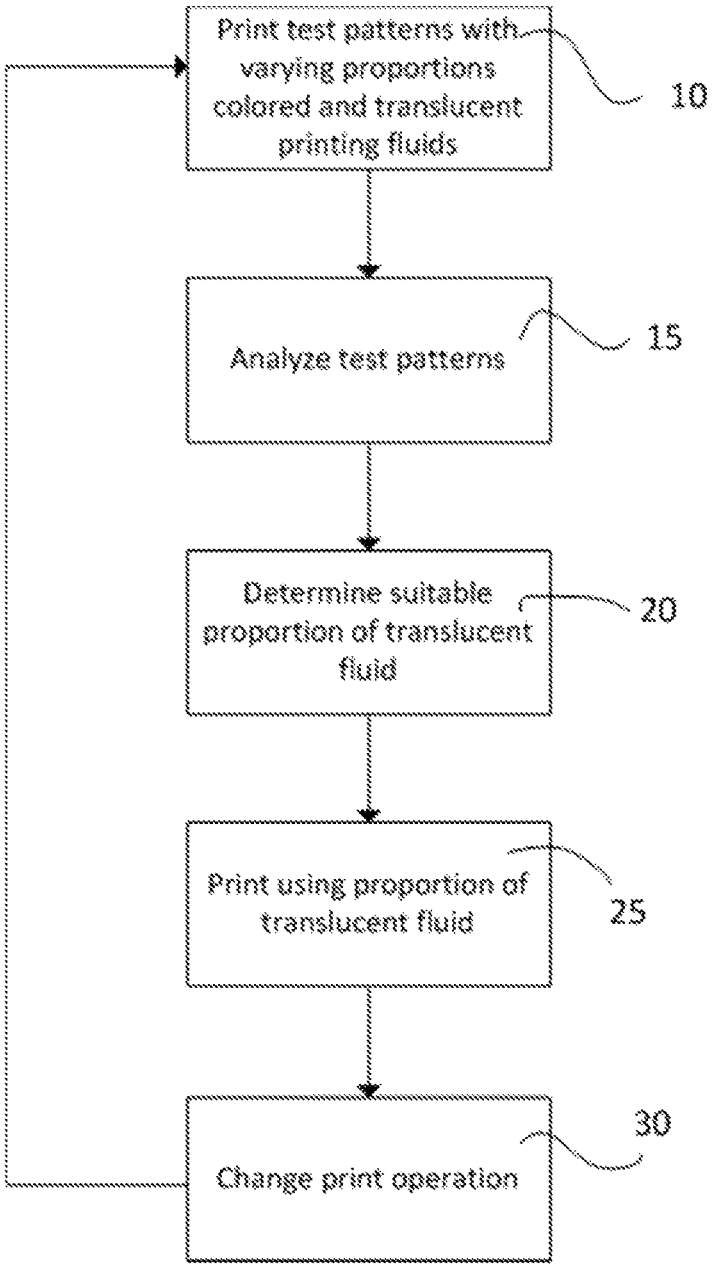
Figure 4A:
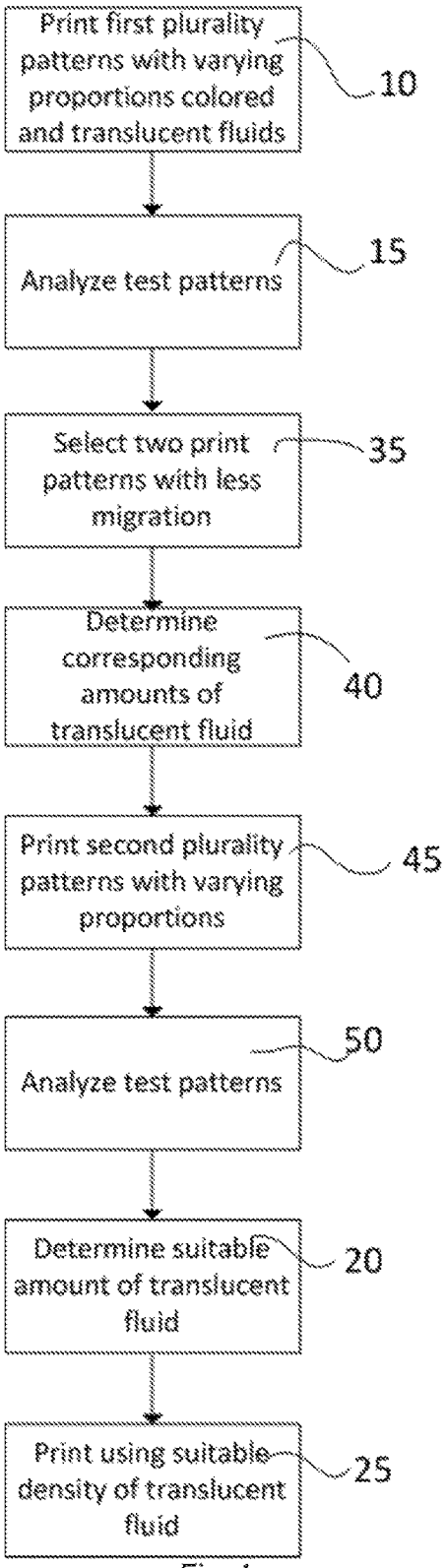

Some non-limiting examples of methods and apparatus for determining an amount of translucent printing fluid will be described in the following with reference to the appended drawings, in which:

FIG. 1*a* shows a flowchart of an example of a method for determining an amount of translucent printing fluid in accordance with an implementation;

FIG. 1*b* schematically illustrates an example of test patterns that may be used in some implementations;

FIG. 1*c* illustrates a flowchart of another example of a method for determining an amount of translucent printing fluid in accordance with another implementation;

FIG. 2 schematically illustrates an example of a plurality of test patterns and an example of a plurality of signals indicative of migration characteristics which may be used in some examples of methods for determining an amount of printing fluid according to some implementations;

FIG. 3 is a flowchart illustrating an example of a method for determining an amount of translucent printing fluid in accordance with an implementation;

FIG. 4*a* is a flowchart illustrating an example of a method for determining an amount of translucent printing fluid in accordance with an implementation.

Figure 4B:
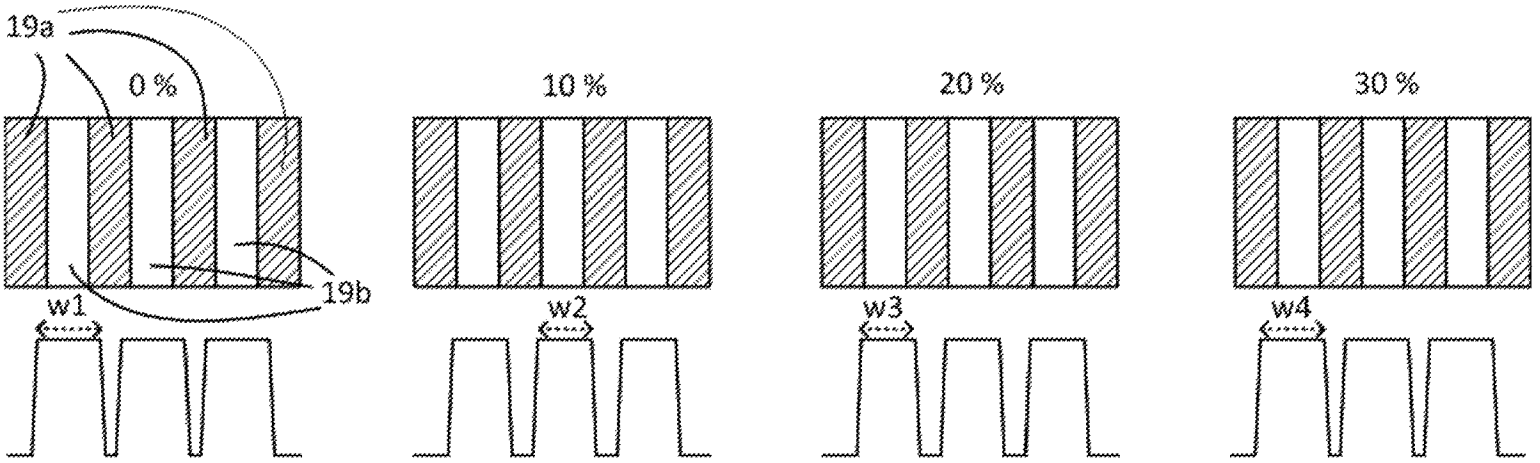
Figure 4C:
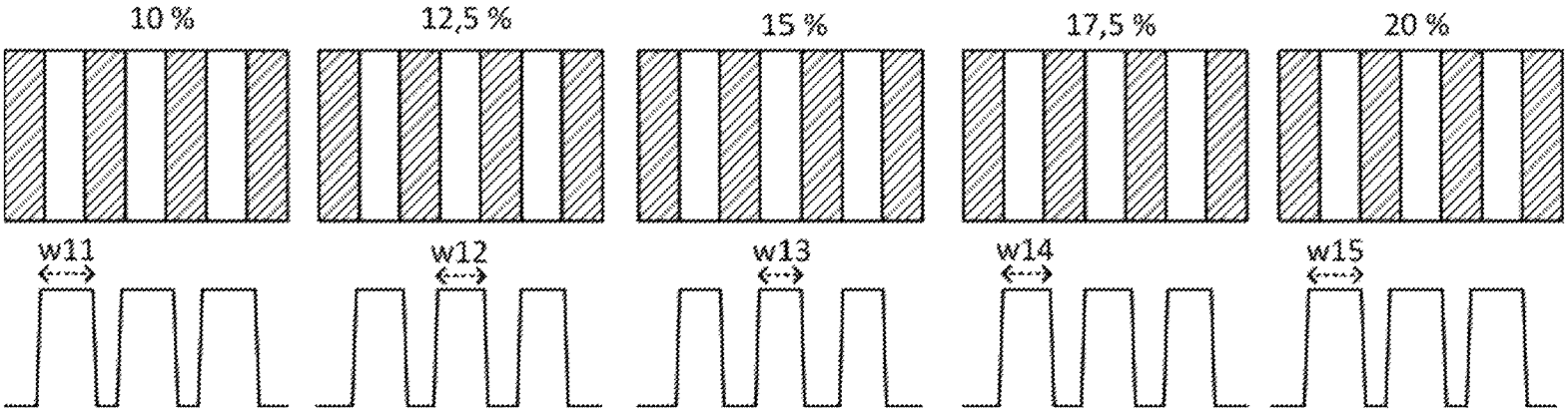
Figure 5:
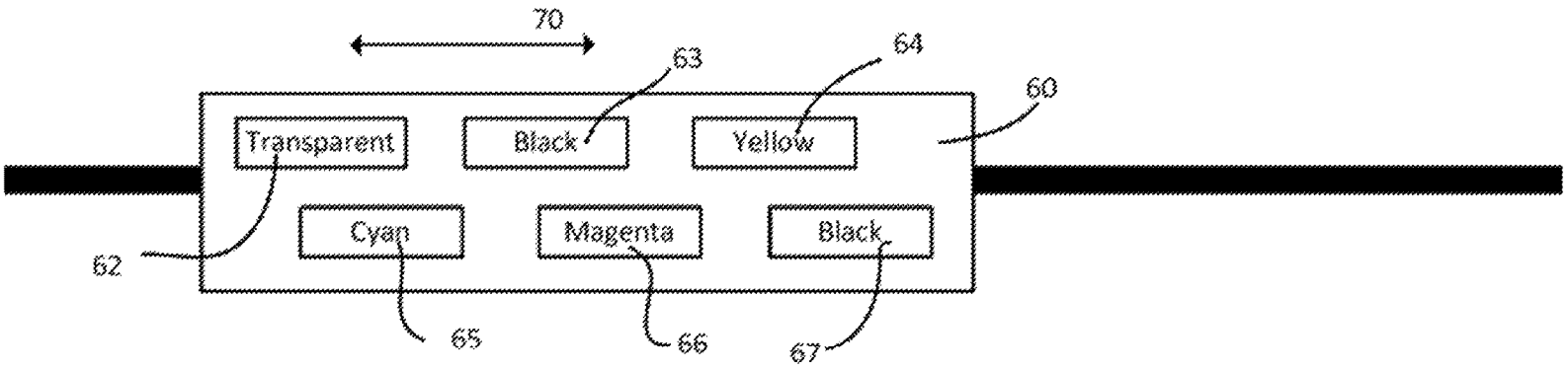

FIGS. 4*b* and 4*c* schematically illustrate test patterns that may be used in such an example; and FIG. 5 schematically illustrates an example of an arrangement of printheads in an inkjet printing system that may be used in examples of a method for determining an amount of translucent printing fluid in accordance with an implementation.

DETAILED DESCRIPTION

FIG. 1*a* illustrates examples of methods for determining an amount of translucent printing fluid to use in combination with a colored printing fluid in a flowchart. In accordance with this implementation, a plurality of test patterns may be printed at block 10 with varying proportions of a colored and a translucent printing fluid. Subsequently, the test patterns may be analyzed as indicated at block 15.

Colored printing fluid as used herein should, be understood to cover black printing fluid and white printing fluid as well as printing fluid of any other color. Translucent printing fluid should herein not be understood as a translucent component of a colored printing fluid. The term translucent throughout this disclosure should be understood to also cover transparent (printing fluids).

FIG. 1*b* illustrates an example of a plurality of test patterns that may be used in such an implementation. Two test patterns 11 and 12 are schematically illustrated. The test pattern 11 may comprise a first area 11*a* and a second area 11*b*, which is contiguous with the first area 11*a*. Similarly, test pattern 12 may include a first area 12*a* and a second area 12*b*, which is contiguous with the first area.

The first area 11*a* may be printed with a colored printing fluid of a different color than the second area 11*b* and similarly for the second test pattern 12. The test patterns 11 and 12 may be substantially similar or the same. The test patterns may be printed using a different amount of translucent printing fluid, while maintaining the amount of colored printing fluid. The proportion of colored printing fluid to translucent printing fluid may thus be changed.

The amount of translucent printing fluid may influence the time it takes to form a bond and the extent to which a bond is formed between the colored printing fluid and the print medium. The bond between a printing fluid and a print medium may depend e.g. on the print medium used. When a different print medium is used, (e.g. paper instead of vinyl, or paper of a different porosity), more or less translucent printing fluid may be needed to form a good and quick bond. Similarly, ambient conditions, such as e.g. the temperature and humidity in a print zone may have an influence on such bonds as well.

Because of an inherent difference in surface tension between a first color printing fluid and a second color printing fluid, migration of printing fluid from the first area 11*a* to the second area 11*b* (or vice versa) may occur. Too much translucent printing fluid may lead to more migration from one area to another. The same happens when too little translucent printing fluid is used. In both scenarios, the bond between the print medium and the printing fluid, in particular the colored printing fluid, may take longer to form. Migration from one color printing fluid to an area of another color increases if it takes longer for the printing fluid to become immobilized on a print medium. Thus the amount of translucent printing fluid may influence the migration characteristics of test patterns with contiguous areas of different color.

By analyzing migration characteristics of the first and the second test pattern, an amount of translucent printing fluid to be used in a successive printing operation may be determined. For example, the test pattern with less migration may be selected. The corresponding amount (proportion) of translucent printing fluid could then be used in a successive printing operation.

This way, regardless of the printing apparatus and print medium used and regardless of the particular ambient conditions or printer settings at any given moment, a suitable amount of translucent printing fluid may be determined. Good printing quality may thus be ensured regardless of a print medium used, ambient conditions etc. using a relatively quick process.

FIG. 1*c* illustrates a flowchart of another example of an implementation. At block 10, a plurality of print patterns with a varying amount (proportion) of a translucent fluid may be printed. These test patterns may then be analyzed at block 15. A suitable amount of translucent printing fluid may be determined at block 20. The determination of the suitable amount may include determining the test pattern with the least migration and selecting the corresponding amount (e.g. proportion) of translucent printing fluid. At block 25, a printing operation may be performed in which the previously determined proportion of translucent printing fluid is used.

FIG. 2 schematically illustrates an example of a plurality of test patterns which may be used in some examples of methods for determining an amount of translucent printing fluid to use in combination with a colored printing fluid according to some implementation. In the example of FIG. 2, five test patterns 13, 14, 16, 17 and 18 are illustrated. Each of these test patterns may be substantially the same, but with a varying proportion of translucent printing fluid.

In this example, the amount of translucent printing fluid may be varied with fixed increments. In this example, a first test pattern 13 may be printed using only colored printing fluid without adding any translucent printing fluid. Test pattern 14 may be printed wherein 5% of the total printing fluid (colored printing fluid+translucent printing fluid) is translucent fluid. The proportion of translucent printing fluid may be increased to 10%, 15% and 20% respectively in test patterns 16, 17 and 18.

Each of the test patterns may comprise a first area, a second area and a third area. In the test patterns, first area 13*a* and third area 13*c* may be of the same color, whereas the second area 13*b* may be of a different color. The first area 13*a* and third area 13*c* may be contiguous with the second area 13. As in the previously disclosed example, because of a difference in surface tension between different colors of printing fluid, trig ration of printing fluid may occur between the different areas.

In some implementations, in order to increase the sensitivity of the test pattern to such migration, the colors of the different areas of the test patterns may be selected based on their surface tension. Two colors of printing fluid with the largest difference in surface tension may thus be selected.

In any of the examples disclosed herein, the colors used in any of the test patterns may be pure primary colors, e.g. pure cyan, yellow, magenta, or black in a CYMK based printing system. However, the test patterns may also be printed using halftone colors and/or secondary colors.

Migration characteristics of the test patterns may be analyzed using a line sensor. In some examples, a line sensor may comprise a LED emitter to emit an optical beam towards the print medium, and a photo transistor detector, to detect the reflection of the optical beam. At the bottom of FIG. 2, examples of an output signal of such a line sensor are schematically illustrated.

The reflection of the optical beam may be different depending on the color of the print. In this example, such signals may have a peak corresponding substantially to the second areas 13*b* etc. that are printed using a different color than the contiguous areas.

In an alternative example, the migration characteristics may be determined by an operator of a printing system. Depending on the level of migration, a test pattern with the best migration characteristics may be distinguishable by the naked eye, or by using a magnification tool.

It may be seen that in this example, the peak w1 corresponding to the test pattern 13 may be wider than e.g. the peak w3 of the test pattern 16. The peak w3 in this example corresponds better to the width of the second area of the test pattern, than e.g. the widths of the peaks w1 and w5. This means that in this particular example, it may be deduced that a proportion of 10% of translucent printing fluid leads to less migration (and thus better image quality in general) than using 0% of translucent printing fluid (or 20% of translucent printing fluid). One conclusion in this example may be to use a proportion of 10% of the translucent printing fluid in a subsequent printing operation under similar conditions (e.g. same printing medium).

FIG. 3 illustrates in a flowchart an example of a method of determining an amount of translucent printing fluid to use in combination with a colored printing fluid in accordance with an implementation.

In the example of FIG. 3, a plurality of test patterns with varying proportions of translucent printing fluid may be printed. Subsequently, at block 15, these test patterns may be analyzed. Subsequently, at block 20, a suitable amount of a translucent printing fluid may be determined. The determination of a suitable amount may comprise selecting the test pattern with least migration and choosing the corresponding amount or proportion of translucent printing fluid. In another example, the determination of a suitable amount of translucent printing fluid may comprise selecting two test patterns with relatively good migration characteristics and choosing a proportion of translucent printing fluid between the two proportions corresponding to the two test patterns.

After a suitable proportion of a translucent printing fluid has been selected, this proportion of a translucent printing fluid may be used in all successive printing operations until an aspect of the printing operations changes. An aspect of printing operations may be that a print medium is changed. When a print medium is changed at block 30, the method for determining a suitable amount of translucent printing fluid may be repeated. The print medium used may have an important influence on the interaction between print medium, colored printing fluid and translucent printing fluid. Repeating a method of determining an amount of translucent printing fluid only when an aspect of a printing operation is changed may mean that print quality may be ensured, whereas unnecessary testing may be avoided.

In another example, an aspect of printing operations that may be changed is the total amount or density of the printing fluid used in an operation. Changing a density of the printing fluid means that per unit area more printing fluid is used when printing. Using more printing fluid overall also has its influence on the interaction between print medium, colored printing fluid and translucent printing fluid. This means that in order to obtain the same print quality when printing with a different density, the proportions of colored and translucent printing fluids may need to change. Before such a new printing operation, any of the examples of methods for determining an amount of translucent printing fluid as herein described may be performed. The print quality of successive printing operations may hereby be improved as the amount of translucent printing fluid may be adjusted.

FIG. 4*a* illustrates in a flowchart another example of a method for determining an amount of translucent printing fluid in accordance with an implementation. This example may further be illustrated with reference to FIGS. 4*b* and 4*c*. As in other examples previously illustrated herein, a method may start by printing a first plurality of test patterns with varying proportions of translucent printing fluid. An example of such a first plurality of test patterns is schematically illustrated on FIG. 4*b*.

Each of the test patterns in this example may comprise a repetitive pattern of areas of a first color 19*a* and areas of a different (second) color 19*b*, which are contiguous with the areas of the first color. After printing the first plurality of test patterns, these patterns may be analyzed. At block 35, the two patterns that exhibit less migration may be selected.

In the example of FIG. 4*b*, the test patterns corresponding to a translucent printing fluid proportion of 10% (of the total amount of printing fluid including colored printing fluid) and corresponding to a translucent printing fluid proportion of 20% exhibit less migration than the other test patterns. The peaks w1 and w4 of the signal in this example are wider than the peaks w2 and w3. In this sense, the widths of the peaks w2 and w3 correspond more closely to the widths of the specific areas of the test pattern.

In accordance with this example, a second plurality of test patterns may be printed at block 45. An example of such a second plurality of test patterns according to an implementation is depicted in FIG. 4*c*. In these test patterns, the proportion of translucent printing fluid may be varied between the previously selected values, i.e. in this case, a plurality of test patterns may be printed wherein the proportion of translucent printing fluid is varied, in smaller increments, between 10% and 20%.

In this example, the proportion of translucent printing fluid may be varied in fixed increments, both for the first plurality of patterns and for the second plurality of patterns. In another example, a variable increment could be used.

In the specific example of FIG. 4*c*, the width w13 of the peak may be seen to be shorter than the widths w11, w12, w14 and w15 of the other peaks.

At block 50 in the example of FIG. 4*a*, the second plurality of test patterns may be analyzed, in particular with respect to migration characteristics. At block 20, a suitable amount for a translucent printing fluid may be selected, e.g. by determining the test pattern of the second plurality with least migration between areas of a first color and areas of another color. In the particular example of FIG. 4*c*, the suitable proportion may be 15%.

The determined proportion of translucent printing fluid may then be used in a successive printing operation.

In an alternative example, a further repetition of printing test patterns and analyzing the migration characteristics could be carried out until a specified or desired print quality is reached.

The present disclosure also relates to printing systems, which are suitable for carrying out any of the example methods for determining an amount of translucent printing fluid. In some implementations such printing systems may be e.g. inkjet printers. Inkjet printers use at least one printhead provided with a plurality of nozzles, from which ink droplets are fired or ejected onto the media; the printer controls the firing of ink from the nozzles such as to create on the media a pattern of dots corresponding to the desired image (or text).

In one type of inkjet printers, the printheads may be mounted on a carriage that reciprocates in successive passes above a print medium along a scan direction, with the nozzles firing droplets of ink as the printhead moves across the medium; after each printing pass of the printheads, the medium is advanced in a media advance direction, at right angles to the scan direction, such that a plot is formed on the medium in successive passes of the printheads. These printheads are sometimes referred to as scanning printheads or shuttle printheads. These printers are sometimes referred to as shuttle printers.

In another type of inkjet printers, the printhead extends over the width of the printer and is static when printing. The nozzles of the printhead fire droplets of ink while the medium advances in a media advance direction. The printheads are sometimes referred to as page wide printheads or full width printheads. These printers are sometimes referred to as full width printers.

Latex ink may be used in examples of inkjet printers. Latex ink may be regarded as a stable dispersion (emulsion) of polymer pigment microparticles in an aqueous medium. Latexes may be natural or synthetic.

The pigment microparticles may be anionic, i.e. they may have a negative surface charge. The negative surface charge may avoid aggregation of pigment particles as the negative charges of different pigment particles repel each other. Clogging of e.g. inkjet nozzles may hereby be avoided. At the same time, once the ink has been ejected onto the print medium, the ink preferably substantially stays in place, i.e. become more viscous.

Preferably, before a print medium exits such a printing apparatus, the ink has been completely dried and cured, such that no external dryer is needed, and the printed medium is ready for use or shipment and can be stored without problems.

Drying of the ink requires evaporation of water present in the ink. This may be achieved by heating air and passing air along the print medium in the area of the print zone, or downstream thereof. Curing may be understood as hardening of the polymers in the ink which leads to the formation of a continuous film. Curing generally requires higher temperatures, such that the continuous film may be formed and a chemical bond is formed with the print medium.

Translucent printing fluid may be used to enhance the bond between colored ink and print medium. The translucent printing fluid may comprise cationic polymers (i.e. they have a positive charge) suspended in a water based ink vehicle. The translucent printing fluid may be ejected from nozzles onto a print medium.

The cationic polymers may be attracted to and may adsorb onto negatively charged pigments of the colored ink. The surface charge of the pigment particles may be neutralized causing them to aggregate and become immobilized on the print medium.

Using a suitable amount of translucent printing fluid in combination with colored latex ink may lead to good printing quality, i.e. sharp text and/or images without the need for drying of the ink. Avoiding a drying stage may lead to higher throughput of print medium. Also the energy efficiency of inkjet printing systems could be improved as less energy may be needed for drying.

Using too much or too little translucent printing fluid without such a drying stage may however lead to the ink not being sufficiently immobilized on the print medium. Different colors of (latex) ink imply different surface tensions: test patterns comprising contiguous areas of different colors in which the ink is not immobilized may lead to migration between areas of different surface tension.

Different sorts of migration may occur between the areas with different surface tension, i.e. areas of different color. Different sorts of migration may include coalescence, bleed, wicking and feathering.

Coalescence may be described as the grouping of ink particles en clusters. This may occur particularly in non-porous print media. Bleed is known as the interaction (migration) between two contiguous colors because of a difference in surface tension. Wicking is known as the interaction (migration) between one or more inks and a non-porous print medium because of a difference in surface tension. Feathering is known as the interaction (migration) between inks in porous print media. As a result, an ink droplet may not have a spherical appearance, but rather "spreads out" on the print medium before becoming immobilized.

FIG. 5 schematically illustrates an example of an arrangement of printheads in an inkjet printing system that may be used in examples of a method for determining an amount of translucent printing fluid in accordance with an implementation. Such inkjet printing systems may comprise a controller to perform examples of the methods for determining an amount of translucent printing fluid disclosed herein.

A carnage 60 may carry a plurality of printheads 62, 63, 64, 65, 66 and 67. Each of these printheads may comprise a plurality of nozzles from which ink droplets are fired may be ejected onto a print medium. A different printhead may be provided for different colors of ink. The carriage may further include a line sensor (not illustrated in this figure) for use in analyses of migration characteristics of test patterns.

In this example, a printhead may be provided for each of the colors cyan, magenta and yellow, whereas two printheads may be provided for the color black. A further printhead 62 with nozzles may be incorporated for ejecting a translucent printing fluid, in this example, a transparent printing fluid. The transparent printing fluid may comprise cationic polymers suspended in a water based ink vehicle which may be attracted to and may adsorb onto negatively charged pigments of the colored inks to immobilize the colored ink on the print medium.

As the carriage reciprocates in successive passes above a print medium, ink droplets and transparent printing fluid may be ejected on the print medium. The inclusion of a printhead dedicated to the transparent printing fluid makes it possible to freely vary the amount of transparent printing fluid to use in combination with the printing fluid, i.e. in this example, the ink.

Depending on the arrangement of the printheads (which may vary e.g. depending on the number of printheads and number of colors), the transparent printing fluid may be provided onto the print medium right before or right after the colored printing fluid.

As the carriage reciprocates above the print medium, the line sensor may scan over the entire width of the print medium and in particular over test patterns with different amounts of transparent printing fluid. A signal from the line sensor may thus be used to determine migration from a first color ink to an area of ink of a different color.

Although only a number of particular implementations and examples have been disclosed herein, further variants and modifications of the disclosed apparatus and methods are possible; other combinations of the features of implementations or examples described are also possible.

The invention claimed is:

1. A method of determining an amount of a translucent printing fluid to use in combination with a colored printing fluid, comprising:

printing a plurality of test patterns with different proportions of the colored printing fluid and the translucent printing fluid, each test pattern of the plurality of test patterns comprising a first area and a second area contiguous with the first area, wherein a color of the second area is different from a color of the first area;

analyzing migration characteristics of the plurality of test patterns with the different proportions of the colored printing fluid and the translucent printing fluid;

determining an amount of the translucent printing fluid to use based on the analyzing of the migration characteristics; and using the determined amount of the translucent printing fluid for a successive printing operation.

2. The method of claim 1, wherein the colored printing fluid is an ink.

3. The method of claim 2, wherein the colored printing fluid is a latex ink.

4. The method of claim 1, wherein the translucent printing fluid comprises cationic polymers suspended in a water based ink vehicle.

5. The method of claim 1, wherein the color of the first area and the color of the second area are selected based on a surface tension of the colors.

6. The method of claim 1, wherein the plurality of test patterns comprise a repetitive pattern of areas of a first color and areas of a different color contiguous with the areas of the first color.

7. The method of claim 1, further comprising:

varying a proportion of the translucent printing fluid in the plurality of test patterns in increments, wherein a first test pattern of the plurality of test patterns includes a first proportion of the colored printing fluid and the translucent printing fluid, and a second test pattern of the plurality of test patterns includes a different second proportion of the colored printing fluid and the translucent printing fluid, and wherein the analyzing of the migration characteristics of the plurality of test patterns comprises analyzing the migration characteristics of the first and second test patterns, and the determining of the amount of the translucent printing fluid to use comprises selecting the first proportion of the colored printing fluid and the translucent printing fluid as the determined amount of the translucent printing fluid to use.

8. The method of claim 1, wherein the determining of the amount of translucent printing fluid to use comprises:

selecting, from the plurality of test patterns, a test pattern having least migration of printing fluid between the first area and the second area; and selecting the proportion of the colored printing fluid and the translucent printing fluid corresponding to the selected test pattern as the determined amount of the translucent printing fluid to use.

9. The method of claim 7, wherein the analyzing of the migration characteristics of the plurality of test patterns comprises determining, for each respective test pattern of the plurality of test patterns, an amount of migration of the colored printing fluid in the respective test pattern between the first area and the second area of the respective test pattern, and wherein the selecting of the first proportion of the colored printing fluid and the translucent printing fluid as the determined amount of the translucent printing fluid to use is based on a comparison of respective amounts of migration of the colored printing fluid in the plurality of test patterns.

10. The method of claim 1, comprising:

printing a first plurality of test patterns, each test pattern of the first plurality of test patterns comprising a first area and a second area contiguous with the first area, wherein a color of the second area is different from a color of the first area, wherein each test pattern of the first plurality of test patterns is printed using a respective different proportion of the colored and translucent printing fluids;

analyzing migration characteristics of the first plurality of test patterns to select two test patterns of the first plurality of test patterns having least migration of printing fluid between the first area and the second area;

determining the proportions of the colored and translucent printing fluids of the two selected test patterns;

printing a second plurality of test patterns, each test pattern of the second plurality of test patterns comprising a first area and a second area contiguous with the first area, wherein a color of the second area is different from a color of the first area, wherein each test pattern of the second plurality is printed using a respective different proportion of the colored and translucent printing fluids; and wherein the proportions of the colored and translucent printing fluids in the second plurality of patterns are varied between the proportions of the two selected test patterns of the first plurality of test patterns; and analyzing migration characteristics of the second plurality of test patterns to determine the amount of translucent printing fluid to use for the successive printing operation.

11. The method of claim 1, further comprising changing a print medium prior to the printing of the plurality of test patterns.

12. The method of claim 1, further comprising changing a print density prior to the printing of the plurality of test patterns.

13. A printing apparatus to determine an amount of translucent printing fluid to use in combination with a colored printing fluid for a successive printing operation, the printing apparatus comprising:

an image forming assembly, a controller to control the image forming assembly; and a sensor, wherein the controller is to:

cause printing, by the image forming assembly, of a plurality of test patterns with different proportions of the colored and translucent printing fluids, the test patterns comprising contiguous areas of different colors; and analyze, based on measurements by the sensor of the printed plurality of test patterns, migration characteristics of the printed plurality of test patterns to determine an amount of translucent printing fluid to use in the successive printing operation.

14. The printing apparatus of claim 13, wherein the image forming assembly comprises a carriage to carry a printhead, and wherein the carriage comprises the sensor.

15. The method of claim 8, wherein a first test pattern of the plurality of test patterns has a first proportion of the colored printing fluid and the translucent printing fluid, and wherein a second test pattern of the plurality of test patterns has a second proportion of the colored printing fluid and the translucent printing fluid, the second proportion different from the first proportion.

16. The method of claim 1, wherein the analyzing comprises:

receiving a first measurement by a sensor of a first test pattern that has a first proportion of the colored printing fluid and the translucent printing fluid, the first measurement comprising a first peak;

receiving a second measurement by the sensor of a second test pattern that has a different second proportion of the colored printing fluid and the translucent printing fluid, the second measurement comprising a second peak;

comparing the first peak to the second peak; and identifying, based on the comparing, which of the first and second test patterns of the plurality of test patterns has a lower migration of color printing fluid between the first and second areas of the first and second test patterns, wherein the determined amount of the translucent printing fluid to use comprises a proportion of the colored printing fluid and the translucent printing fluid in the test pattern identified based on the comparing from among the first and second test patterns.

17. The method of claim 16, wherein comparing the first peak to the second peak comprises comparing a first width of the first peak to a second width of the second peak, and wherein the one of the first and second test patterns identified as having the lower migration of color printing fluid is based on determining which of the first and second widths is smaller.

18. The method of claim 1, wherein the analyzing comprises:

receiving respective measurements by a sensor of the plurality of test patterns, each of the measurements comprising a respective peak;

comparing the peaks of the measurements; and identifying, based on the comparing, which of the plurality of test patterns has a lower migration of color printing fluid between the first and second areas of the plurality of test patterns.

19. The printing apparatus of claim 13, wherein the analyzing of the migration characteristics of the plurality of test patterns comprises determining, for each respective test pattern of the plurality of test patterns, an amount of migration of the colored printing fluid in the respective test pattern between the contiguous areas of the respective test pattern, and wherein the controller is to:

compare the amounts of migration of the colored printing fluid in the test patterns between the contiguous areas of the plurality of test patterns;

identify a test pattern from among the plurality of test patterns, based on the identified test pattern having a least amount of migration of the colored printing fluid between the contiguous areas of the identified test pattern; and use a proportion of the colored printing fluid and the translucent printing fluid in the identified test pattern as the determined amount of the translucent printing fluid to use in the successive printing operation.

20. The printing apparatus of claim 19, wherein the controller is to use the determined amount of translucent fluid in the successive printing operation.

21. The printing apparatus of claim 13, wherein the controller is to:

receive a first measurement by the sensor of a first test pattern including a first proportion of the colored printing fluid and the translucent printing fluid, the first measurement comprising a first peak;

receiving a second measurement by the sensor of a second test pattern including a second proportion of the colored printing fluid and the translucent printing fluid, the second measurement comprising a second peak;

comparing the first peak to the second peak; and identifying, based on the comparing, which of the first and second test patterns of the plurality of test patterns has a lower migration of color printing fluid between the contiguous areas of the first and second test patterns.

22. The printing apparatus of claim 21, wherein the controller is to select the proportion of the colored printing fluid and the translucent printing fluid in the test pattern identified based on the comparing, to use as the determined amount of translucent fluid in the successive printing operation.

* * * * *